US006718625B2

(12) United States Patent
Ito et al.

(10) Patent No.: US 6,718,625 B2
(45) Date of Patent: Apr. 13, 2004

(54) METHODS OF MANUFACTURING INDUCTORS

(75) Inventors: Yoichiro Ito, Omihachiman (JP); Toshio Kawabata, Yokaichi (JP); Takahiro Yamamoto, Omihachiman (JP); Hiroshi Komatsu, Omihachiman (JP); Tadashi Morimoto, Hikone (JP); Takashi Shikama, Yokaichi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 306 days.

(21) Appl. No.: 09/861,732

(22) Filed: May 21, 2001

(65) Prior Publication Data

US 2002/0020052 A1 Feb. 21, 2002

Related U.S. Application Data

(63) Continuation of application No. 09/309,567, filed on May 11, 1999, now abandoned.

(30) Foreign Application Priority Data

May 12, 1998 (JP) ..... 10-129118
May 12, 1998 (JP) ..... 10-129119
Jun. 25, 1998 (JP) ..... 10-179404

(51) Int. Cl.[7] ..... H01F 7/06

(52) U.S. Cl. ..... 29/606; 29/602.1; 336/200; 336/223

(58) Field of Search ..... 29/606, 605, 602.1, 29/608; 336/83, 192, 200, 221, 233, 96, 229; 264/123, 236

(56) References Cited

U.S. PATENT DOCUMENTS

| | | | | | |
|---|---|---|---|---|---|
| 5,165,162 | A | | 11/1992 | Charles | |
| 5,932,165 | A | * | 8/1999 | Corbett et al. | 264/328.2 |
| 6,045,748 | A | * | 4/2000 | Hayashi | 264/669 |
| 6,154,112 | A | * | 11/2000 | Aoba et al. | 336/192 |
| 6,311,387 | B1 | * | 11/2001 | Shikama et al. | 29/602.1 |
| 6,460,244 | B1 | * | 10/2002 | Shafer et al. | 29/608 |
| 2002/0020052 | A1 | * | 2/2002 | Ito et al. | 29/606 |

FOREIGN PATENT DOCUMENTS

| | | | | |
|---|---|---|---|---|
| EP | 1058280 | * | 6/2000 | |
| JP | 58-132907 | * | 8/1983 | 29/593 |
| JP | 4-88604 | * | 3/1992 | 264/123 |
| JP | 11-121234 | | 4/1999 | |
| JP | 11-126724 | * | 5/1999 | |

* cited by examiner

*Primary Examiner*—Carl J. Arbes
*Assistant Examiner*—Minh Trinh
(74) *Attorney, Agent, or Firm*—Keating & Bennett, LLP

(57) ABSTRACT

An method of manufacturing an inductor having a large current capacity which includes a magnetic sintered body formed via wet pressing treatment and a coil assembly disposed within the magnetic sintered body. The coil assembly is defined by a substantially cylindrical magnetic core member which is wound by a coil. Both ends of the coil of the coil assembly are respectively and electrically connected to an input electrode and an output electrode which are respectively disposed on two mutually facing end surfaces of the magnetic sintered body.

20 Claims, 12 Drawing Sheets

METHODS OF MANUFACTURING INDUCTORS

This application is a continuation of application Ser. No. 09/309,567, filed May 11, 1999, now abandoned.

BACKGROUND OF THE INVENTION

1. Field of the Invention

The present invention relates to methods of manufacturing inductors, and more particularly, to methods of manufacturing inductors which can be used in a noise filter, a transformer and a common mode choke coil.

2. Description of the Related Art

A known laminated type inductor 1 for use in a noise filter is shown in FIG. 21 and FIG. 22. As shown in FIG. 21, the conventional inductor 1 includes a plurality of magnetic sheets 2 having a plurality of conductor patterns 11*a*–11*d* provided on surfaces thereof. A magnetic sheet 3 serves as a cover for covering the magnetic sheets 2. The conductor patterns 11*a*–11*d* are connected to define a spiral coil 11, by way of a plurality of via holes 14*a*–14*c* formed through the plurality of magnetic sheets 2. In this way, upon laminating together the magnetic sheets 2 and the top magnetic sheet 3 in a predetermined manner as shown in FIG. 21, it is necessary to perform a sintering process of the entire laminated structure to produce a laminated body 7 as shown in FIG. 22. Further, one end surface of the laminated body 7 is provided with an input electrode 10*a* of the coil 11, while the other end surface thereof is provided with an output electrode 10*b* of the coil 11.

However, with the above conventional inductor 1, since each of the conductor patterns 11*a*–11*d* has only a small thickness and hence has only a small cross sectional area, the coil 11 has only a small current capacity which allows an electric current to flow therethrough. Further, in a process of manufacturing the conventional inductor 1, since it is required to form a plurality of conductor patterns 11*a*–11*d*, the whole manufacturing process must include a large number of steps which results in a high manufacturing cost.

SUMMARY OF THE INVENTION

In order to overcome the problems described above, preferred embodiments of the present invention provide improved inductors each having an increased current capacity and each being constructed to be manufactured at a very low cost.

According to one of the preferred embodiments of the present invention, an inductor includes a coil assembly having an electrically conductive wire or a magnetic core member and an electrically conductive wire wound around the magnetic core member, the coil assembly being provided within a magnetic sintered body which has been formed by molding a ceramic slurry into a predetermined shape and sintering to produce a magnetic sintered body, and end portions of the electrically conductive wire are electrically connected to external electrodes provided on outer surfaces of the magnetic sintered body.

In using the above inductor having the above-described structure, a magnetic sintered body which has been formed by molding a ceramic slurry into a predetermined shape and sintered, functions as a path of a magnetic flux generated by the electrically conductive wire. Further, since the electrically conductive wire has a relatively large cross section which is larger than that of the conductor patterns of a conventional laminated type inductor, the electrically conductive wire has a greatly reduced direct current resistance, thereby significantly increasing the current capacity of the inductor.

Further, according to additional preferred embodiments of the present invention, there is provided an inductor in which a plurality of coil assemblies each being electrically independent from each other and including a magnetic core member and an electrically conductive wire wound around the magnetic core member, are contained within a magnetic sintered body which has been formed by molding a ceramic slurry into a predetermined shape and sintering to produce a magnetic sintered body, thereby forming an array type inductor having a greatly increased current capacity. Moreover, since either a plurality of non-magnetic members or a plurality of internal spaces are provided between the plurality of coil assemblies in the magnetic sintered body, formation of a magnetic circuit between each pair of adjacent coil assemblies is effectively prevented by either the non-magnetic members or the internal spaces. In this way, a desired result is reliably provided. That is, a magnetic flux generated by one coil assembly will not form an interconnection with another magnetic flux generated by an adjacent coil assembly.

Further, according to additional preferred embodiments of the present invention, there is provided an inductor in which at least one pair of mutually electrically connected coil assemblies, each including a magnetic core member and an electrically conductive wire wound around the magnetic core member, are contained within a magnetic sintered body which has been formed by molding a ceramic slurry into a predetermined shape and sintering to produce a magnetic sintered body. As a result, it is possible to form an inductor having an increased current capacity, which is suitable for use as a transformer or a common mode choke coil. At least one pair of coil assemblies may be formed either by winding a plurality of electrically conductive wires around one magnetic core member or by winding a plurality of electrically conductive wires around a plurality of magnetic core members.

Usually, when an inductor having a plurality of coil assemblies is used as a transformer or a common mode choke coil, the following phenomenon will occur in an area of a magnetic sintered body between two adjacent coil assemblies. More specifically, a part of a magnetic flux which has been generated by one coil assembly but does not form an interconnection with a magnetic flux generated by the other assembly, will enter into and exit from an area located between the two coil assemblies, thereby forming a magnetic circuit of a magnetic flux which contributes only to a self-inductance. In view of this phenomenon, if a non-magnetic member(s) or an internal space(s) is provided between the at least one pair of coil assemblies, a part of the magnetic sintered body between the at least one pair of coil assemblies, will have a higher magnetic resistance, thereby effectively preventing any entering and exiting of a magnetic flux with respect to this area. In this way, the non-magnetic member(s) or the internal space(s) effectively prevent any formation of a magnetic circuit of a magnetic flux which contributes only to a self-inductance. As a result, a large part of a magnetic flux generated by one coil assembly will form an interconnection with a magnetic flux generated by the other assembly. More specifically, within the magnetic sintered body, a magnetic flux is created so as to have an interconnection with adjacent coil assemblies. That is, the magnetic flux creates a magnetic circuit of a magnetic flux which contributes to both a self-inductance and a mutual inductance.

Further, according to additional preferred embodiments of the present invention, a method of manufacturing an inductor includes the steps of preparing a slurry for use in a wet pressing treatment and containing a magnetic ceramic material, introducing the slurry into a mold which already contains therein at least one electrically conductive wire or at least one coil assembly each including a magnetic core member and an electrically conductive wire wound around the magnetic core member, and performing the wet pressing treatment to obtain a magnetic molded body, sintering the magnetic molded body containing the at least one electrically conductive wire or the at least one coil assembly so as to form a magnetic sintered body, and forming on outer surfaces of the magnetic sintered body external electrodes electrically connected to end portions of the at least one electrically conductive wire.

With the use of the above method, i.e., a wet pressing method according to at least one preferred embodiment of the present invention, an inductor is manufactured via a greatly simplified process with a reduced cost, without having to use a complex process, such as that used to produce a laminated type inductor of the related art, which involves printing conductor patterns and laminating together a plurality of magnetic sheets. Further, since the slurry is sufficiently pressed during the wet pressing treatment, water contained in the slurry may be sufficiently removed therefrom, thereby effectively preventing formation of air bubbles within the slurry and thus ensuring a good quality for a molded product. In addition, since the electrically conductive wire is wound around the magnetic core member, any deformation of the electrically conductive wire is reliably prevented.

Further, a method for manufacturing an inductor according to additional preferred embodiments of the present invention is such that the method includes the steps of introducing a batch of slurry into a mold to perform a wet pressing treatment to produce a magnetic molded plate, forming a plurality of coil assemblies each having a magnetic core member and an electrically conductive wire wound around the magnetic core member or at least one coil assembly having an electrically conductive wound wire, fixing the coil assemblies or the at least one coil assembly having the electrically conductive wound wire on the magnetic molded plate, introducing another batch of slurry into a mold in which the magnetic molded plate has been placed, and performing the wet pressing treatment so as to obtain a magnetic molded body containing the coil assemblies. With the use of such a method, it is possible that after a plurality of coil assemblies have been fixed on a magnetic molded plate, the magnetic molded plate may be placed into the mold for forming the magnetic molded body. As a result, it is not necessary to directly place the plurality of coil assemblies into the mold, thereby ensuring an improved productivity for manufacturing the inductors.

Other features and advantages of the present invention will become apparent from the following description of the invention which refers to the accompanying drawings.

DETAILED DESCRIPTION OF PREFERRED EMBODIMENTS

Figure 1:
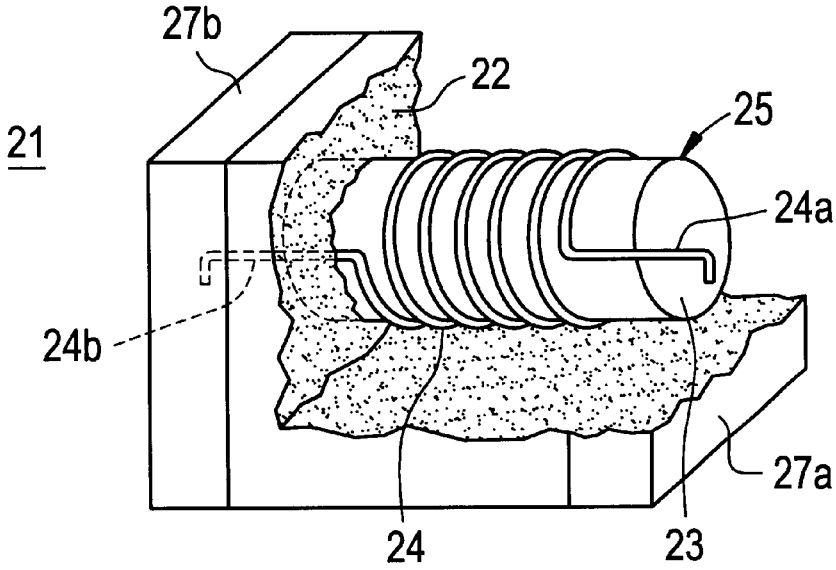
FIG. 1 is a partially broken perspective view schematically illustrating an inductor according to a first preferred embodiment of the present invention.

In the following, several preferred embodiments of the present invention showing several types of inductors and several methods of manufacturing the inductors will be described in detail with reference to the accompanying drawings. However, in the descriptions of the following preferred embodiments, the same elements and sections will be represented by the same reference numerals, and some repeated explanations will therefore be omitted.

FIG. 1 is a partially broken perspective view schematically illustrating an inductor 21 according to a first preferred embodiment of the present invention. As shown in FIG. 1, the inductor 21 includes a magnetic sintered body 22 preferably made of a ferrite material and having a substantially rectangular parallelepiped shape, and a coil assembly 25 disposed within the magnetic sintered body 22. The coil assembly 25 is preferably defined by a substantially cylindrical magnetic core member 23 which is wound by a coil 24. In practice, the magnetic sintered body 22 may be formed via a process called a wet pressing treatment which will be described in more detail later. Both ends 24*a*, 24*b* of the coil 24 of the coil assembly 25 are respectively electrically connected to an input electrode 27*a* and an output electrode 27*b* which are respectively disposed on two mutually facing end surfaces of the magnetic sintered body 22.

Figure 2:
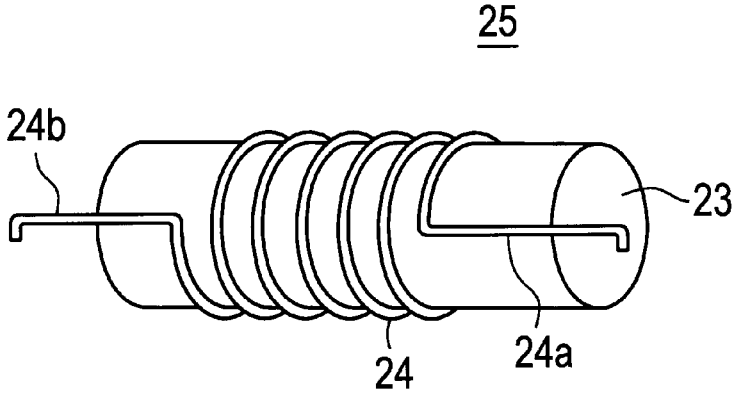
FIG. 2 is a perspective view schematically illustrating a coil assembly for use in the inductor shown in FIG. 1.

Now, a method of manufacturing the inductor 21 with the use of a wet pressing treatment will be described with reference to FIGS. 2–7. As shown in FIG. 2, at first, a substantially cylindrical magnetic core member 23 preferably made of a ferrite material and preferably having a diameter of, for example, about 1.5 mm is prepared. Then, a coil 24 which is preferably made of a silver wire having a diameter of, for example, about 200 $\mu$m, is prepared, to thereby produce a coil assembly 25 as shown in FIGS. 1 and 2. The magnetic core member 23 is preferably made of a NiCuZn ferrite sintered at a temperature of about 910° C. The magnetic core member 23 is not required to be used in the present invention and it may be omitted due to a specific property required by a predetermined product specification. However, in general, the silver wire is wound around the magnetic core member 23 about 6 times so that its coiled portion will be about 2.5 mm, thereby obtaining a coil assembly as shown in FIG. 2. In this preferred embodiment, a length of each of linear end portions 24*a* and 24*b* of the coil 24 is preferably about 0.75 mm.

Alternatively, the spiral coil 24 may be formed in advance, and a sintered magnetic core member 23 is inserted into the coil 24, thereby obtaining a similar coil assembly 25.

In preparing a slurry for use in forming a magnetic sintered body 22 with the use of a wet pressing treatment, a raw material for forming such a slurry may be a NiCuZn ferrite in a granular powder state having a granule size of about 2.2 $\mu$m and a specific surface area of about 2.25 $m^2/g$. The raw material powder, water, a dispersing agent (polyoxyalkylene glycol), a defoaming agent (a polyether defoaming agent), and a binding agent (an acrylic binder), are put into a pot with a predetermined weight relationship as shown in Table 1, and then mixed together in a ball-mill for 17 hours, thereby obtaining a desired slurry 22*a* shown in FIG. 3.

TABLE 1

| | Parts by weight with respect to raw material powder |
|---|---|
| Water content | 45.0% |
| Dispersing agent | 1.2% |
| Defoaming agent | 0.2% |
| Binder | 0.5% |

Figure 3:
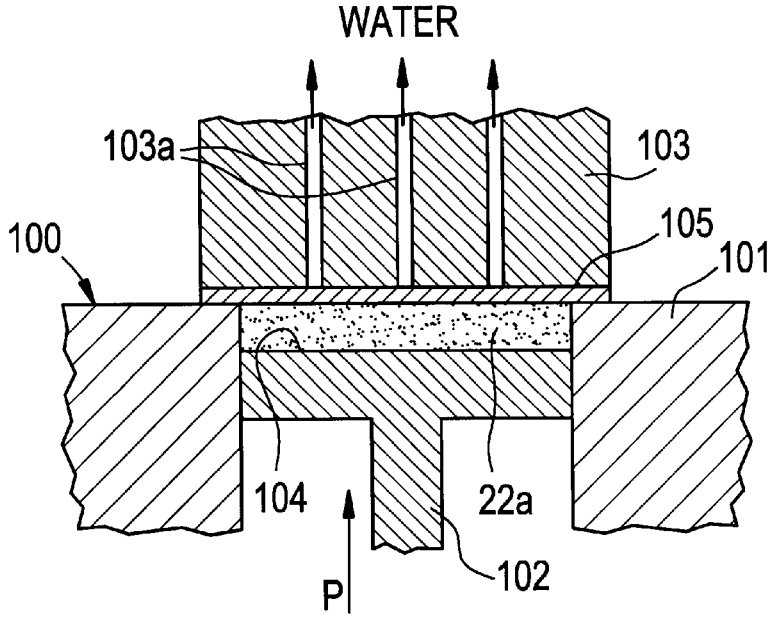
FIG. 3 is a sectional view schematically illustrating one step of a method for manufacturing the inductor shown in FIG. 1.

As shown in FIG. 3, the slurry 22*a* is introduced into a mold 100 so as to undergo a predetermined wet pressing treatment. The mold 100 has a frame section 101, a pressing section 102, and a pressing force receiving section 103. In this manner, the slurry 22*a* is allowed to flow into a recess portion 104 defined by the frame section 101 and the pressing section 102. Once the slurry 22*a* is completely introduced into the recess portion 104, a filter 105 which is constructed to only allow water to pass therethrough, is used to cover up the opening of the recess portion 104, followed by a packing treatment in the section 103 so as to prevent a possible leakage of the slurry 22*a*. Then, the pressing section 102 is caused to move in a direction shown by an arrow P in FIG. 3, and a pressure of 100 $kgf/cm^2$ is applied to the slurry 22*a* for 5 minutes, thereby causing the water contained in the slurry 22*a* to escape through the filter 105 and escaping bores 103*a* formed within the section 103, thus obtaining a magnetic plate 22*m* as shown in FIG. 4.

Figure 4:
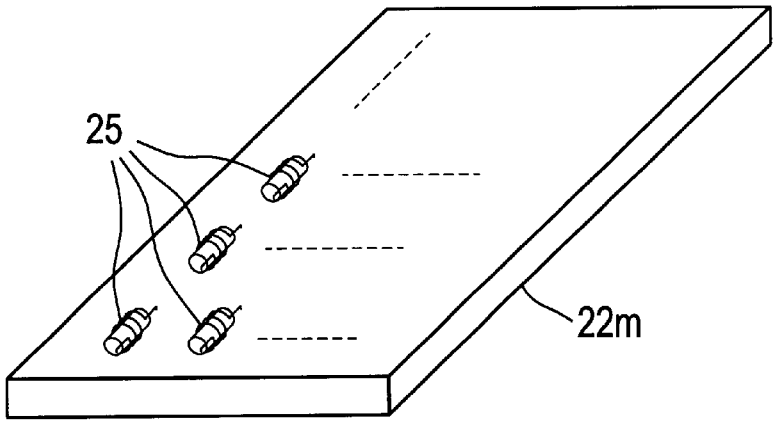
FIG. 4 is a perspective view schematically illustrating a subsequent step following the step of FIG. 3 for manufacturing the inductor shown in FIG. 1.
Figure 5:
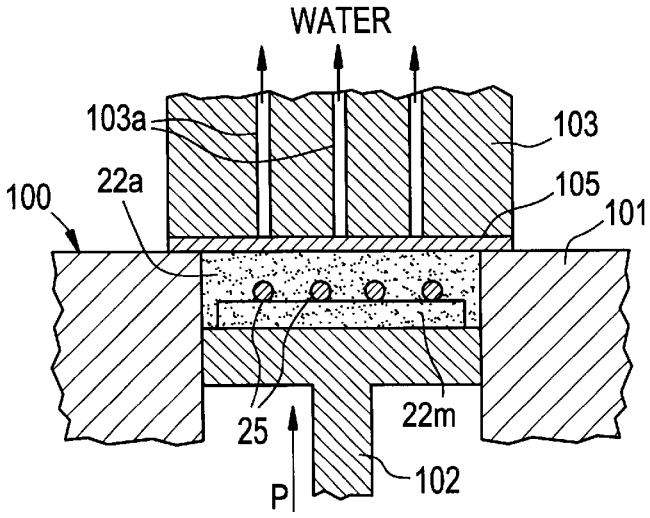
FIG. 5 is a sectional view schematically illustrating a subsequent step following the step of FIG. 4 for manufacturing the inductor shown in FIG. 1.
Figure 6:
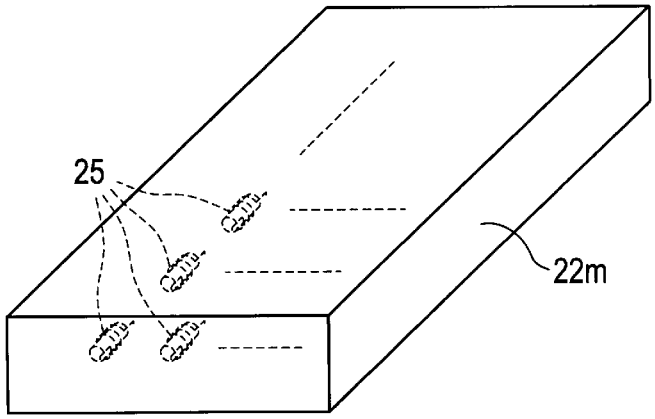
FIG. 6 is a perspective view schematically illustrating a subsequent step following the step of FIG. 5 for manufacturing the inductor shown in FIG. 1.

Referring to FIG. 4, on the upper surface of the magnetic plate 22*m* there are provided a plurality of coil assemblies 25 having longitudinal axes arranged to extend in a horizontal plane or substantially parallel to the mounting surface of the plate 22. Then, in order to prevent the coil assemblies 25 from deviating away from respective predetermined positions, an adhesive agent or a slurry is applied to prevent such a possible deviation. After that, as shown in FIG. 5, the magnetic plate 22*m* fixedly supporting the plurality of coil assemblies 25 is moved into the mold 100 again, and a predetermined amount of slurry 22*a* is introduced into the mold 100, so that a predetermined wet pressing treatment can be performed. As soon as the predetermined amount of slurry 22*a* has been completely introduced into the mold 100, a filter 105 which is constructed to allow only water to pass therethrough is used to cover up the opening of the mold 100, followed by a packing treatment in the section 103 so as to prevent a possible leakage of the slurry 22*a*. Then, the pressing section 102 is caused to move in a direction shown by an arrow P in FIG. 5, and a pressure of 100 $kgf/cm^2$ is applied to the slurry 22*a* for 5 minutes, thereby causing the water contained in the slurry 22*a* to escape through the filter 105 and the escaping bores 103*a* formed within the section 103, thus obtaining a magnetic mother plate 22M containing the plurality of coil assemblies 25, as shown in FIG. 6.

Figure 7:
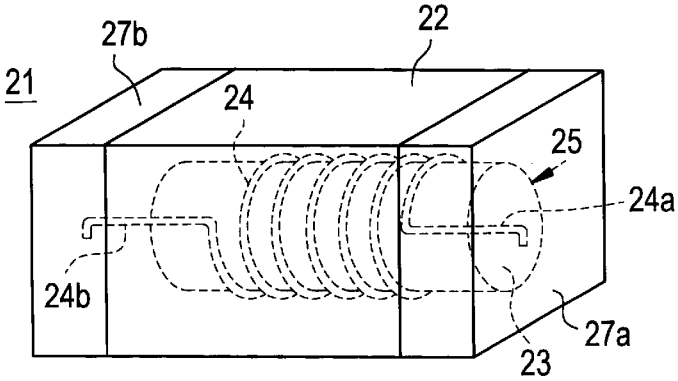
FIG. 7 is a perspective view schematically illustrating a step following the step of FIG. 6 for manufacturing the inductor shown in FIG. 1.

Subsequently, the magnetic mother plate 22M is dried at a temperature of about 35° C. for approximately 48 hours, and is moved into a sheath made of alumina so as to be baked at a temperature of about 910°C. for approximately 2 hours. In this way, a magnetic mother sintered plate 22M is produced and is cut into a plurality of smaller members, thereby producing a plurality of magnetic sintered members 22 each containing a coil assembly 25. After that, one end of each sintered member 22 is provided with an external electrode 27*a* and the other end thereof is provided with another external electrode 27*b*, all via sputterring, vapor deposition or electroless plating, thereby obtaining a desired inductor 21 as shown in FIG. 7.

In this manner, an inductor 21 may be produced with the use of the wet pressing treatment, forming a magnetic sintered member 22 which functions as a magnetic path allowing the passing of a magnetic flux generated by an internal coil assembly 25. Therefore, an inductor is constructed to enable manufacturing via a greatly simplified process with a significantly reduced cost, without having to use a complex process which involves printing conductor patterns and laminating a plurality of magnetic sheets.

Further, a coil 24 wound around the magnetic core member 23 has a much larger electric conductivity and a much larger cross section area than a conventional conductor pattern formed by printing an electrically conductive paste. Therefore, a coil assembly 25 has greatly reduced resistance for a direct current and thus has a relatively large current capacity. As a result, an inductor 21 produced according to the method described above has only a small calorific power, thereby ensuring a stabilized magnetic property when used.

Moreover, since the coil 24 has been previously wound around the magnetic core member 23, even if pressure is applied to the coil 24 when a slurry is introduced into the mold 100, deformation of a coiled portion of the coil 24 is prevented, thereby ensuring a stabilized and reliable magnetic property. In addition, when a magnetic mother plate 22M is baked, cracking of the magnetic mother plate 22M is prevented because of the coil being previously wound on the magnetic core member 23, which cracking will otherwise occur due to a possible shrinkage of the coiled portion of the coil 24. Further, since the slurry is pressed and thus its water component is allowed to escape so as to form a magnetic member, no air bubbles are produced in the slurry, thereby ensuring the formation of a magnetic member that is free of any internal air bubbles. In addition, the coil 24 may be obtained by selecting from various metal wires of different diameters but all having a high electric conductivity. For example, a silver wire may be selected to form such a coil 24 which will satisfy a predetermined product specification.

Table 2 includes measurement results indicating a direct current resistance and a rated current of an inductor 21 made according to above-described method of a preferred embodiment of the present invention. Also included in Table 2, for the purpose of comparison, is a direct current resistance and a rated current of a conventional inductor of a laminated type which was made according to related art. It is understood from Table 2 that the inductor of preferred embodiments of the present invention has a relatively smaller value of direct current resistance and a relatively larger value of current capacity.

TABLE 2

| | Inductor of the preferred embodiment of present invention | Inductor of related art |
|---|---|---|
| Direct current resistance (Ω) | 0.05–0.1 | 0.6 |
| Rated current (A) | 2–3 | 0.2 |

Figure 8:
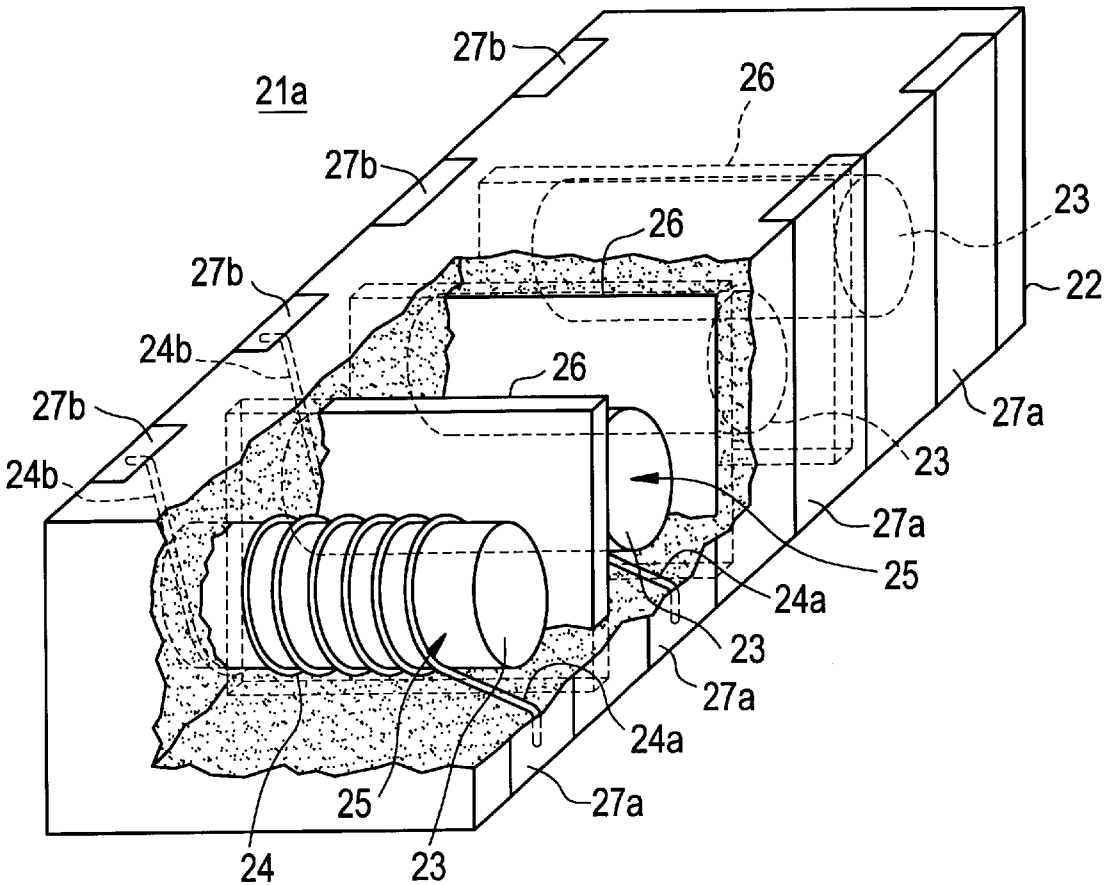
FIG. 8 is a partially broken perspective view schematically illustrating an inductor according to a second preferred embodiment of the present invention.

FIG. 8 is a partially broken perspective view schematically illustrating an inductor 21*a* made according to a second preferred embodiment of the present invention. As shown in FIG. 8, the inductor 21*a* is preferably used as a noise filter of an array type. The inductor 21*a* includes a substantially rectangular parallelepiped magnetic molded body 22 made of a ferrite material, and a plurality of coil assemblies 25 (for example, 4 coil assemblies in FIG. 8) each formed by winding a coil 24 around a solid, substantially cylindrical magnetic core member 23. In fact, the plurality of coil assemblies 25 are arranged and positioned such that they are electrically independent from one another. Similarly, as described in the first preferred embodiment of the present invention, the magnetic molded body 22 is a sintered member which may be formed by using a similar wet pressing treatment. More specifically, each coil assembly 25 is disposed between two square plates 26 made of a non-magnetic material such as alumina, with all the longitudinal axes thereof being arranged in the same direction. Further, in the same manner as in the above first preferred embodiment, one end 24*a* of each coil 24 is electrically connected to an input electrode 27*a* on one end surface of a coil assembly 25, the other end 24*b* thereof is electrically connected to an output electrode 27*b* on the other end surface of the coil assembly 25. Here, each non-magnetic plate 26 is required to have a sufficient size such that each coil assembly 25 may be sufficiently hidden between two adjacent plates 26. For this reason, each non-magnetic plate 26 is designed to have a length that is longer than that of a coil assembly 25 and a width that is larger than the diameter of the coil assembly 25.

In this manner, an inductor 21*a* may be produced with the use of the wet pressing treatment so as to form a magnetic sintered member 22 which functions as a magnetic path allowing the passing of a magnetic flux generated by all of the internal coil assemblies 25. Therefore, an inductor 21*a* is manufactured via a simplified process with a greatly reduced cost, without having to use a complex process which involves printing conductor patterns and laminating a plurality of magnetic sheets on each other.

Further, a coil 24 wound around the magnetic core member 23 in this preferred embodiment of the present invention has a much larger electric conductivity and cross section area compared to a conventional conductor pattern formed by printing an electrically conductive paste according to a prior art method. Therefore, each coil assembly 25 has a reduced resistance for a direct current and thus, has a relatively large current capacity. As a result, an inductor 21*a* produced by this method has only a small calorific power, thereby ensuring a stabilized magnetic property when used.

Further, since a non-magnetic plate 26 is disposed between each pair of adjacent coil assemblies 25, 25, an undesired formation of a magnetic circuit between the two adjacent coil assemblies 25, 25 is reliably prevented. In this way, a magnetic flux generated by each coil assembly 25 may be prevented from forming an undesired interconnection with an adjacent coil assembly 25, thereby effectively preventing an undesired signal leakage or noise leakage between two adjacent coil assemblies 25, 25.

Figure 9:
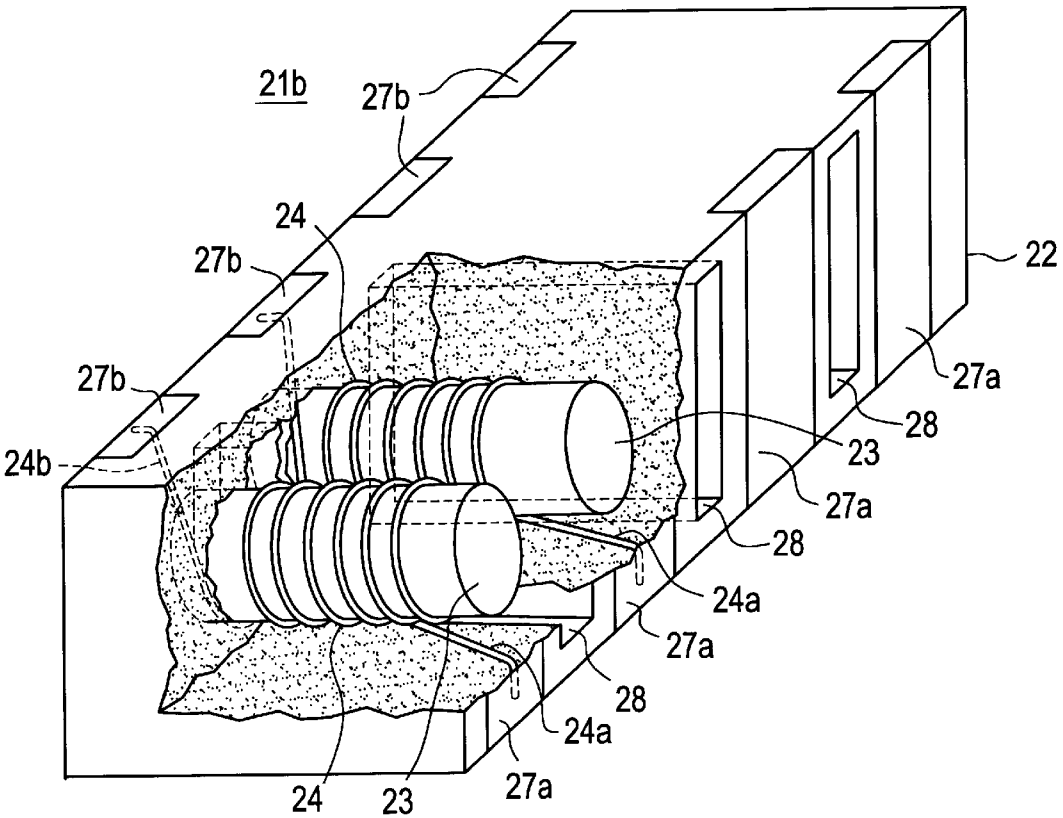
FIG. 9 is a partially broken perspective view schematically indicating an inductor according to a third preferred embodiment of the present invention.

FIG. 9 is a partially broken perspective view schematically illustrating an inductor 21*b* according to a third preferred embodiment of the present invention. As shown in FIG. 9, the inductor 21*b* includes a plurality of internal spaces 28. In fact, each internal space 28 is used to replace a non-magnetic plate 26 used in the inductor 21*a* of the second preferred embodiment shown in FIG. 8, and is formed within a magnetic sintered body 22. Similar to a non-magnetic plate 26, each internal space 28 is disposed between two adjacent coil assemblies 25, 25. In practice, such internal spaces 28 may be formed by using a mold having a plurality of inwardly protruding portions for forming such spaces 28. More specifically, a similar wet pressing treatment may be used and a slurry is poured into a mold, but the slurry does not fill some predetermined portions within the mold, so as to form the desired internal spaces 28 within a magnetic sintered body 22.

In this way, with an inductor 21*b* having the above-described structure, a similar effect as achieved in the inductor 21*a* according to the second preferred embodiment of the present invention is reliably achieved in the third preferred embodiment. Since an internal pace 28 is disposed between each pair of adjacent coil assemblies 25, 25, an undesired formation of a magnetic circuit between the two adjacent coil assemblies 25, 25 is reliably prevented. In this way, a magnetic flux generated by each coil assembly 25 may be prevented from forming an undesired interconnection with an adjacent coil assembly 25, thereby effectively preventing a signal leakage or a noise leakage between two adjacent coil assemblies 25, 25.

Figure 10:
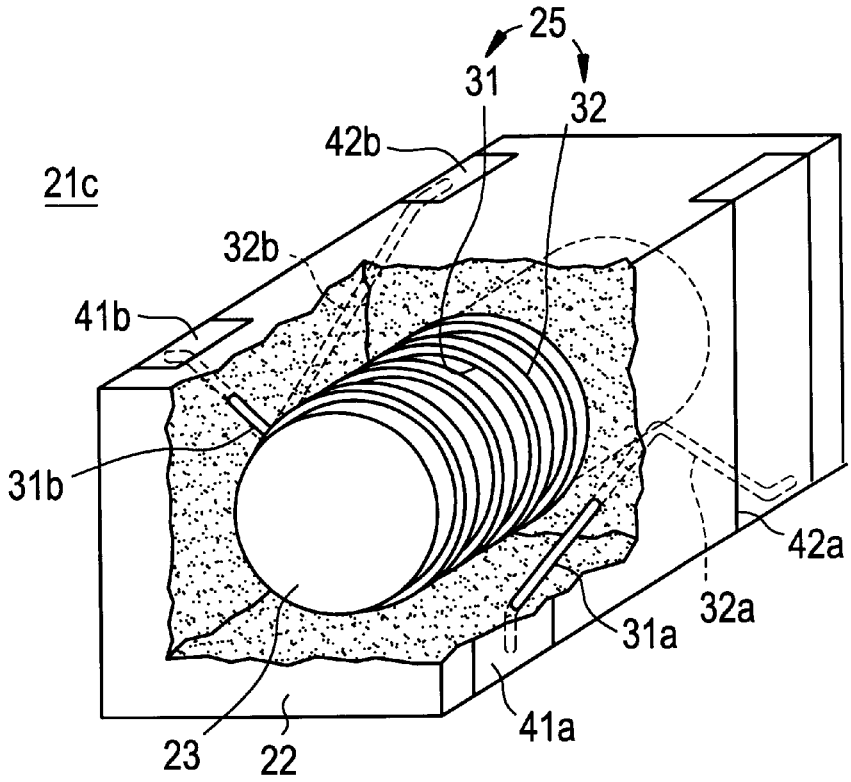
FIG. 10 is a partially broken perspective view schematically indicating an inductor according to a fourth preferred embodiment of the present invention.

FIG. 10 is a partially broken perspective view schematically illustrating an inductor 21*c* made according to a fourth preferred embodiment of the present invention. The inductor 21*c* shown in FIG. 10 may be used as a transformer or a common mode choke coil. As shown in FIG. 10, the inductor 21*c* includes a substantially rectangular parallelepiped magnetic sintered body 22 made of a ferrite material, and a plurality of coil assemblies 25 (in FIG. 10, there are only two coil assemblies 25, 25) contained within the sintered body 22. The two coil assemblies 25 shown in FIG. 10 are formed by winding in the same direction a pair of coils 31, 32 around a solid, substantially cylindrical magnetic core member 23, thereby forming a bifilar winding arrangement. In fact, the magnetic sintered body 22 may be formed with the use of a wet pressing treatment which has been described in detail in the above first preferred embodiment of the present invention. In the present preferred embodiment, the magnetic core member 23 is arranged in a manner such that its longitudinal axis is coincident with a longitudinal direction of the magnetic sintered body 22.

Figure 11:
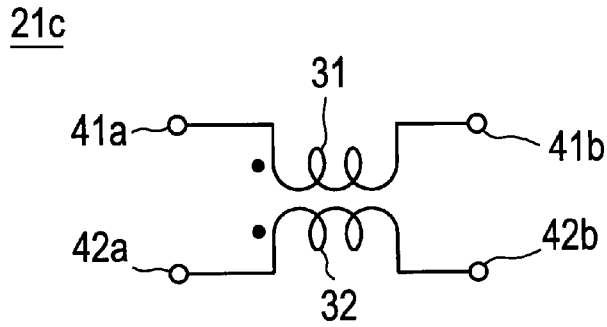
FIG. 11 shows an equivalent electric circuit for the inductor shown in FIG. 10.

One end 31*a* of the coil 31 is electrically connected to an input electrode 41*a*, the other end 31*b* of the coil 31 is electrically connected to an output electrode 41*b*. The input electrode 41*a* and the output electrode 41*b* are provided on two opposite side surfaces of the magnetic sintered body 22. Similarly, one end 32*a* of the coil 32 is electrically connected with an input electrode 42*a*, the other end 32*b* of the coil 32 is electrically connected with an output electrode 42*b*. The input electrode 42*a* and the output electrode 42*b* are disposed on the two opposite side surfaces of the magnetic sintered body 22. FIG. 11 shows an equivalent electrical circuit for the inductor 21*c* of the fourth preferred embodiment of the present invention.

In this manner, an inductor 21*c* may be produced with the use of the wet pressing treatment, forming a magnetic sintered member 22 which functions as a magnetic path allowing the passing of magnetic flux generated by all of the internal coil assemblies 25. Therefore, an inductor 21*c* is manufactured via a greatly simplified process with a reduced cost, without having to use a complex process which involves printing conductor patterns and laminating a plurality of magnetic sheets on each other.

Further, the coils 31 and 32 wound around the magnetic core member 23 according to this preferred embodiment have much larger electric conductivities and cross section areas as compared to a conventional conductor pattern formed by printing an electrically conductive paste in the prior art. Therefore, the coils 31 and 32 have reduced resistance for a direct current and thus have a relatively large current capacity. As a result, an inductor 21*c* produced according to the method of this preferred embodiment has only a small calorific power, thereby ensuring a stabilized magnetic property when used.

Further, when using the inductor 21*c*, since the magnetic sintered body 22 and the magnetic core member 23 are formed of the same magnetic material, they have the same magnetic property, so that there is no disturbance of magnetic flux on a boundary between the magnetic sintered body 22 and the magnetic core member 23. For this reason, a magnetic resistance of a closed magnetic circuit formed between the magnetic sintered body 22 and the magnetic core member 23 is significantly decreased, thereby causing a coupling coefficient between two coil assemblies 25, 25 becomes higher, thus improving the magnetic performance of the inductor 21*c*. A total coupling coefficient of the inductor 21*c* is about 80%.

Figure 12:
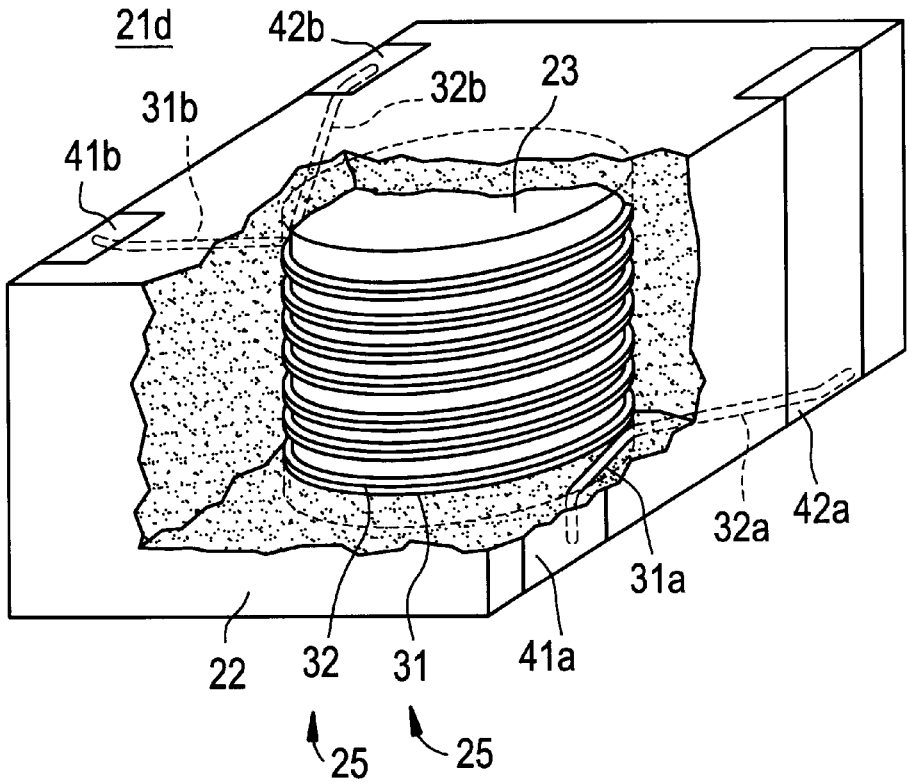
FIG. 12 is a partially broken perspective view schematically illustrating an inductor according to a fifth preferred embodiment of the present invention.

FIG. 12 is a partially broken perspective view schematically illustrating an inductor 21*d* according to a fifth preferred embodiment of the present invention. As shown in FIG. 12, the inductor 21*d* may be formed by arranging the longitudinal axis of the magnetic core member 23 of the inductor 21*c* (shown in FIG. 10) in a direction which is substantially to the longitudinal direction of the magnetic sintered body 22. However, other portions or arrangements of the inductor 21*d* are preferably the same as those of the inductor 21*c* according to the fourth preferred embodiment of the present invention, and may be manufactured via the same method used in the fourth preferred embodiment. As a result, the inductor 21*d* provides the same function and the same effect as provided by the inductor 21*c* of the fourth preferred embodiment.

Figure 13:
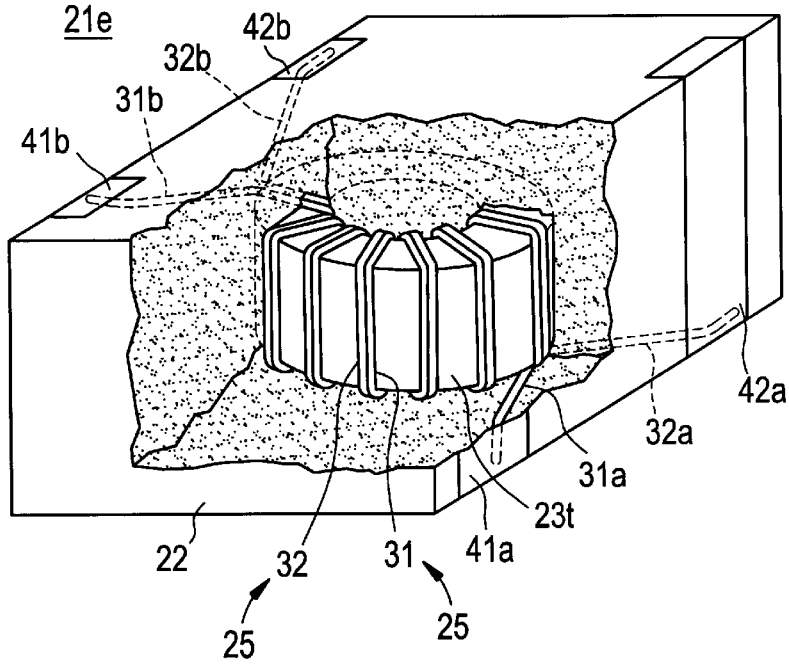
FIG. 13 is a partially broken perspective view schematically illustrating an inductor according to a sixth preferred embodiment of the present invention.

FIG. 13 is a partially broken perspective view schematically illustrating an inductor 21*e* according to a sixth preferred embodiment of the present invention. As shown in FIG. 13, the inductor 21*e* is constituted on the basis of the inductor 21*c* shown in FIG. 10, including a substantially rectangular parallelepiped magnetic sintered body 22 made of a ferrite material, and a plurality of coils 31, 32 contained within the sintered body 22. The coils 31, 32 are wound around a toroidal magnetic core member 23*t* having an substantially annular configuration. In fact, the inductor 21*e* of the sixth preferred embodiment of the present invention has the same function and the same effect as provided by the inductor 21*c* made in the fourth preferred embodiment.

Figure 14:
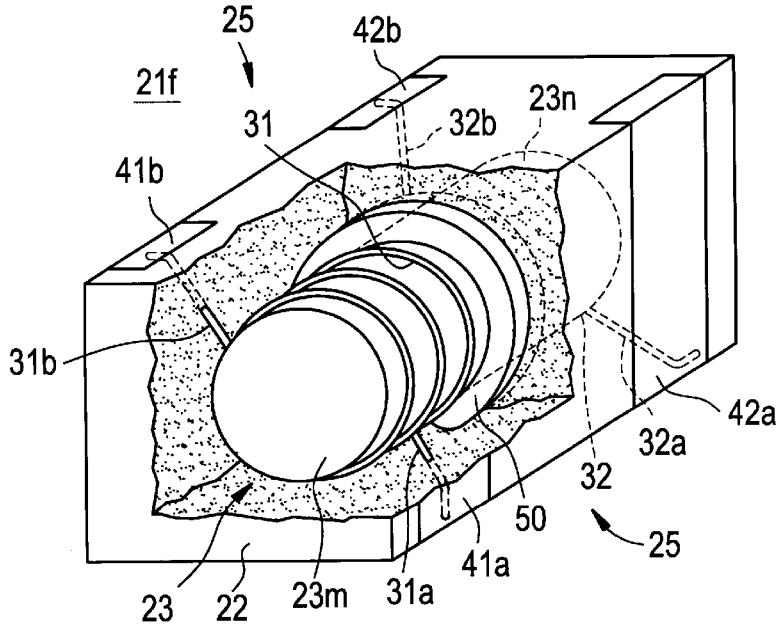
FIG. 14 is a partially broken perspective view schematically illustrating an inductor according to a seventh preferred embodiment of the present invention.

FIG. 14 is a partially broken perspective view schematically illustrating an inductor 21*f* according to a seventh preferred embodiment of the present invention. As shown in FIG. 14, the inductor 21*f* is constituted on the basis of the inductor 21*c* shown in FIG. 10, including a substantially rectangular parallelepiped magnetic sintered body 22 made of a ferrite material, and two coils 31, 32 contained within the sintered body 22. One coil 31 is wound around one end 23*m* of a solid, substantially cylindrical magnetic core member 23, the other coil 32 is wound around the other end 23*n* of the core member 23, with the central portion of the core member 23 serving as a boundary. Further, between two coil assemblies 25, 25 including the two coils 31, 32, there is provided a non-magnetic member 50 preferably having a ring-shaped configuration made of an alumina material. Such a ring-shaped alumina member 50 is attached on to the peripheral surface of the magnetic core member 23. The non-magnetic member 50 has a size such that it can be used to prevent the formation of a magnetic circuit formed by a magnetic flux which contributes only to a self-inductance, while ensuring the formation of a magnetic circuit formed by a magnetic flux which contributes to both a self-inductance and a mutual inductance. The inductor 21*f* according to the seventh preferred embodiment of the present invention has the same function and the same effect as provided by the inductor 21*c* of the fourth preferred embodiment, and will be described in detail below.

The inductor 21*f* is formed by winding two coils 31 and 32 around a magnetic core member 23 separately at different positions thereof. Thus, if the non-magnetic member 50 is not provided, the core member 23 will have the following phenomenon at a position between the two coil assemblies 25, 25 including the two coils 31 and 32. That is, a part of a magnetic flux which has been generated by one coil assembly 25 but does not form an interconnection with a magnetic flux generated by the other assembly 25, will enter into and exit from an area located between the two coil assemblies 25, 25, hence defining a magnetic circuit of a magnetic flux which contributes only to a self-inductance. On the other hand, if the non-magnetic member 50 is provided at a position as shown in FIG. 14, a part of the magnetic sintered body 22 located between the two coil assemblies 25, 25 including the two coils 31 and 32, have a higher magnetic resistance, thereby effectively preventing a possible entering and exiting of a magnetic flux with respect to this area. In this way, the non-magnetic member 50 may be used to reliably and precisely prevent a possible formation of a magnetic circuit of a magnetic flux which contributes only to a self-inductance. As a result, a large part of a magnetic flux generated by one coil assembly 25 form an interconnection with a magnetic flux generated by the other assembly 25. Within the magnetic sintered body 22, a magnetic flux constituting an interconnection with both of the coil assemblies 25, 25 is formed thereby defining a magnetic circuit of a magnetic flux contributing to both a self-inductance and a mutual inductance. In this way, even if the coils 31 and 32 are separately wound around the magnetic core member 23 at different positions, it is still possible to obtain a large coupling coefficient between the two coil assemblies 25, 25 including the two coils 31 and 32. The provision of the non-magnetic member 50 enables the coupling coefficient to be increased from about 50% (a coupling coefficient when the non-magnetic member 50 is not provided) to about 95%.

Figure 15:
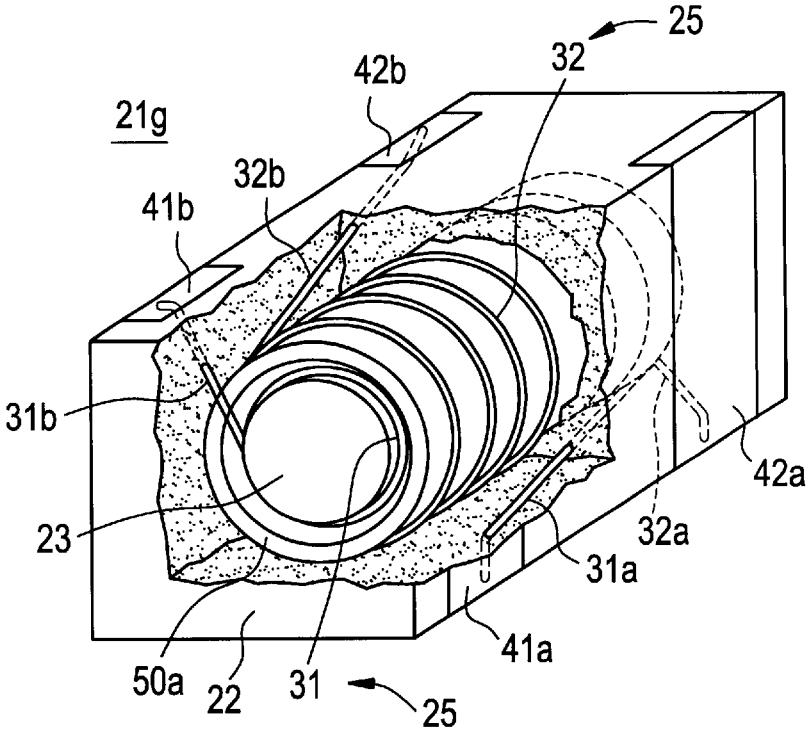
FIG. 15 is a partially broken perspective view schematically illustrating an inductor according to an eighth preferred embodiment of the present invention.

FIG. 15 is a partially broken perspective view schematically illustrating an inductor 21*g* according to an eighth preferred embodiment of the present invention. As shown in FIG. 15, the inductor 21*g* is constituted on the basis of the inductor 21*c* shown in FIG. 10, including a substantially rectangular parallelepiped magnetic sintered body 22 made of a ferrite material, and two coils 31, 32 contained within the sintered body 22. One coil 32 is wound around a substantially cylindrical non-magnetic member 50*a* made of an alumina material, while a substantially cylindrical magnetic core member 23 wound by the other coil 31 is coaxially attached to the substantially cylindrical non-magnetic member 50*a*.

In the present preferred embodiment, the inductor 21*g* is formed by interposing a non-magnetic member 50*a* between two coil assemblies 25, 25 including the coils 31 and 32. As a result, a cubic area located between the two coil assemblies has a higher magnetic resistance, thereby effectively preventing any entering and exiting of a magnetic flux with respect to this area. In this way, the non-magnetic member 50*a* may be used to reliably and precisely prevent a formation of a magnetic circuit of a magnetic flux which contributes only to a self-inductance. As a result, a large part of a magnetic flux generated from one end of the magnetic core member 23 will not pass through the inner side of the substantially cylindrical non-magnetic member 50*a*, but will pass through the outside of the non-magnetic member 50*a*, so as to arrive at the other end of the magnetic core member 23. In other words, a large part of a magnetic flux generated by one coil assembly 25 will form an interconnection with a magnetic flux generated by the other coil assembly 25. More specifically, within the magnetic sintered body 22, a magnetic flux constituting an interconnection with both of the coil assemblies 25, 25, is formed so as to define a magnetic circuit of a magnetic flux contributing to both a self-inductance and a mutual inductance. For this reason, even if the inductor 21*g* is formed in the same manner as in the seventh preferred embodiment for forming the inductor 21*f*, it is still possible to obtain a large coupling coefficient between the two coil assemblies 25, 25 including the two coils 31 and 32. The provision of the non-magnetic member 50*a* allows the coupling coefficient to be increased from about 60% (a coupling coefficient when the non-magnetic member 50*a* is not provided) to about 98%.

Figure 16:
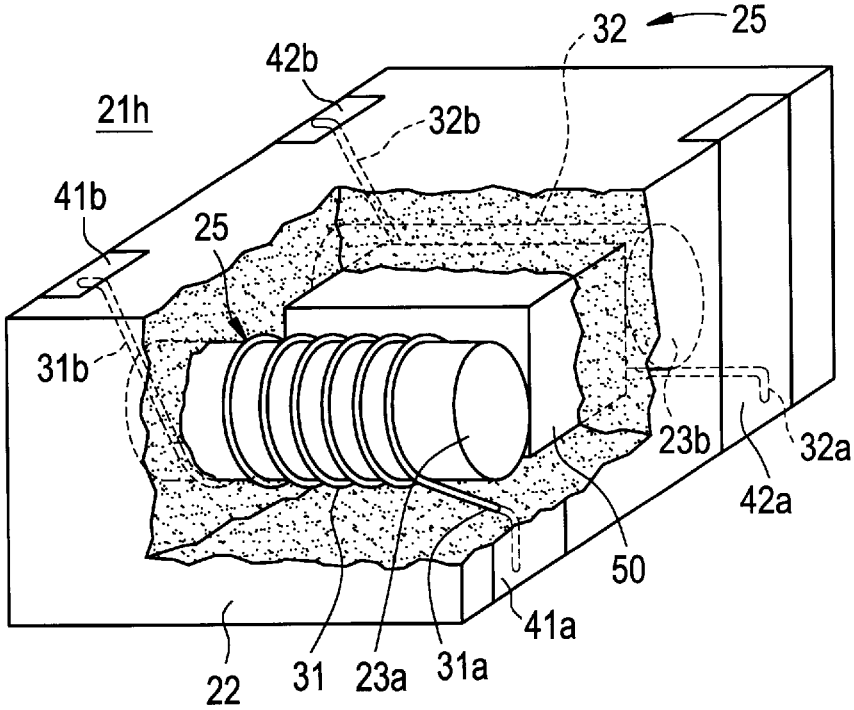
FIG. 16 is a partially broken perspective view schematically illustrating an inductor according to a ninth preferred embodiment of the present invention.

FIG. 16 is a partially broken perspective view schematically illustrating an inductor 21*h* according to a ninth preferred embodiment of the present invention. As shown in FIG. 16, the inductor 21*h* is constituted on the basis of the inductor 21*c* shown in FIG. 10, including a substantially rectangular parallelepiped magnetic sintered body 22 made of a ferrite material, and two coils 31, 32 contained within the sintered body 22. One coil 31 is wound around one substantially cylindrical magnetic core member 23*a*, the other coil 32 is wound around another substantially cylindrical magnetic core member 23*b*. In more detail, the two substantially cylindrical magnetic core members 23*a* and 23*b* are arranged in a mutually substantially parallel relationship, but separated by a substantially cylindrical non-magnetic member 50 made of an alumina material.

In the present preferred embodiment, the inductor 21*h* is formed by interposing a non-magnetic member 50 between two coil assemblies 25, 25 including the coils 31, 32 wound around the two cylindrical magnetic core members 23*a* and 23*b*. As a result, an area located between the two coil assemblies 25, 25 in the magnetic sintered body 22 has a higher magnetic resistance, thereby effectively preventing any entering and exiting of a magnetic flux with respect to this area. In this way, the non-magnetic member 50 may be used to reliably and precisely prevent formation of a magnetic circuit of a magnetic flux which contributes only to a self-inductance. As a result, a large part of a magnetic flux generated from one coil assembly 25 will form an interconnection with a magnetic flux generated by the other assembly 25. More specifically, within the magnetic sintered body 22, a magnetic flux constituting an interconnection with both of the coil assemblies 25, 25 is formed so as to define a magnetic circuit of a magnetic flux contributing to both a self-inductance and a mutual inductance. For this reason, it is possible to obtain a large coupling coefficient between the two coil assemblies 25, 25 including the two coils 31 and 32. The provision of the non-magnetic member 50 allows the coupling coefficient to be increased from about 40% (a coupling coefficient when the non-magnetic member 50 is not provided) to about 92%.

Figure 17:
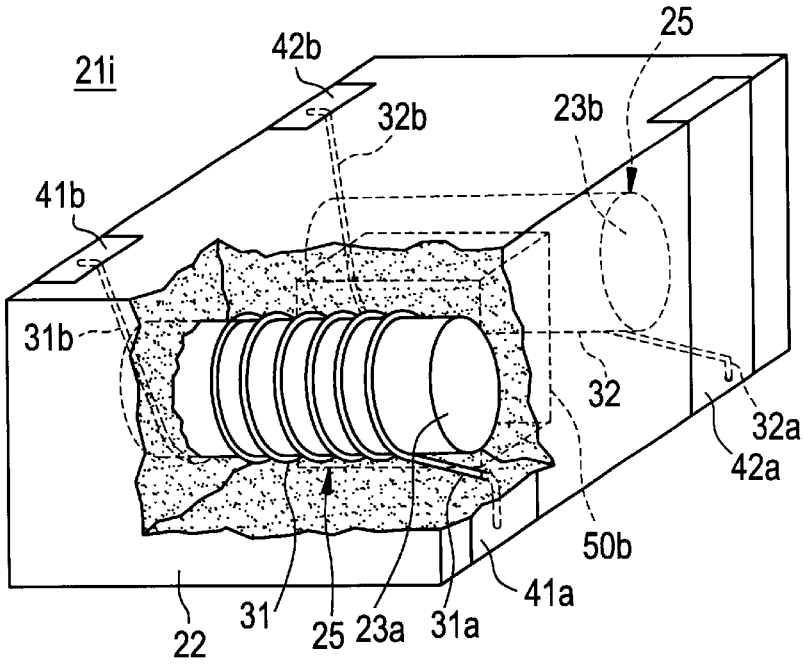
FIG. 17 is a partially broken perspective view schematically illustrating an inductor according to a tenth preferred embodiment of the present invention.

FIG. 17 is a partially broken perspective view schematically illustrating an inductor 21*i* according to a tenth preferred embodiment of the present invention. As shown in FIG. 17, the inductor 21*i* is constituted on the basis of the inductor 21*h* shown in FIG. 16, by replacing the non-magnetic member 50 with an internal space 50*b* formed within the magnetic sintered body 22. In fact, the inner space 50*b* is formed between two adjacent coils 31 and 32. Such an internal space 50*b* may be formed by using a mold having an inwardly protruding portion for forming such an internal space 50*b*. A wet pressing treatment similar to that described above is used and a slurry is poured into a mould, without the slurry filling a predetermined portion within the mold, so as to form the desired internal space 50*b* within the magnetic sintered body 22.

With the inductor 21*i* of the present preferred embodiment having the above-described structure, since the internal space 50*b* has a similar magnetic resistance as the non-magnetic member 50 in the above ninth preferred embodiment of the present invention, the present preferred embodiment achieves the same effect obtained by using the inductor 21*h* of the ninth preferred embodiment. The provision of the internal space 50*b* enables the coupling coefficient to be increased from about 40% (a coupling coefficient when the inner space 50*b* is not provided) to about 92%.

Figure 18:
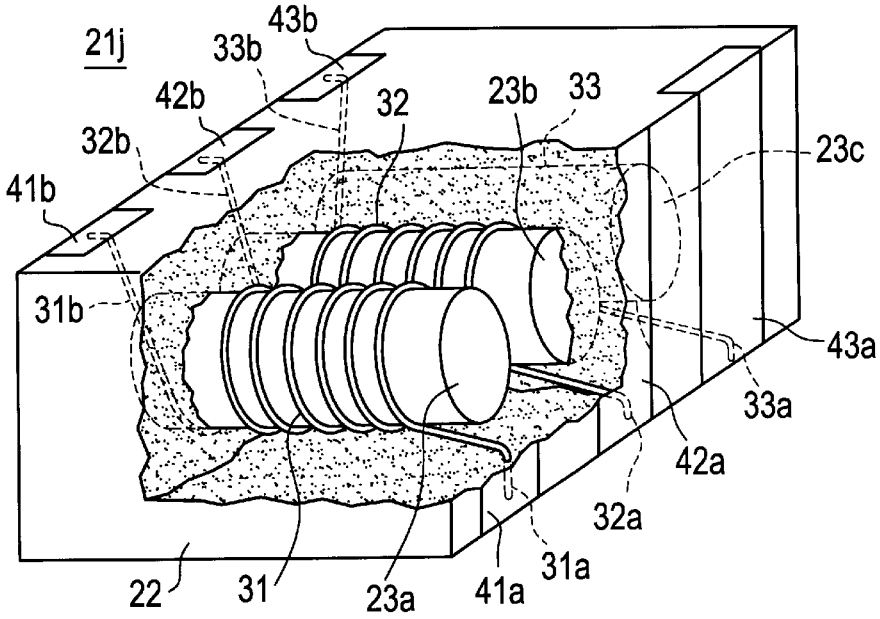
FIG. 18 is a partially broken perspective view schematically illustrating an inductor according to a eleventh preferred embodiment of the present invention.
Figure 19:
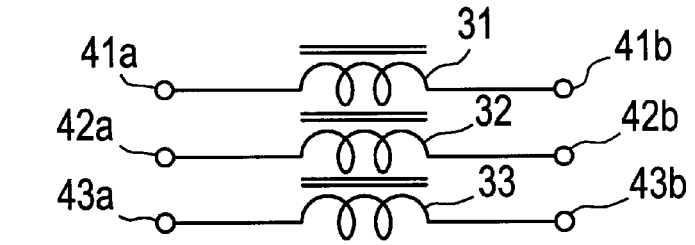
FIG. 19 shows an equivalent electric circuit for the inductor shown in FIG. 18.

The principles of preferred embodiments of the present invention are also suitable for use in making an inductor involving the use of three coils. As shown in FIG. 18, an inductor 21*j* may include three coils 31–33 wound around three solid, substantially cylindrical magnetic core members 23*a*–23*c* which are arranged in a substantially parallel relationship within a magnetic sintered body 22. One end 31*a* of the coil 31 is electrically connected to an input electrode 41*a*, while the other end 31*b* of the coil 31 is electrically connected to an output electrode 41*b*. Similarly, one end 32*a* of the coil 32 is electrically connected to an input electrode 42*a*, while the other end 32*b* of the coil 32 is electrically connected to an output electrode 42*b*. Further, one end 33*a* of the coil 33 is electrically connected to an input electrode 43*a*, while the other end 33*b* of the coil 33 is electrically connected to an output electrode 43*b*. In this manner, the input electrodes 41*a*–43*a* and the output electrodes 41*b*–43*b* are located on opposite sides of the magnetic sintered body 22. Further, the inductor 21*j* may be manufactured in the same manner as in the first preferred embodiment of the present invention, thereby achieving a large current capacity. FIG. 19 shows an equivalent electric circuit for the inductor 21*j*.

Figure 20:
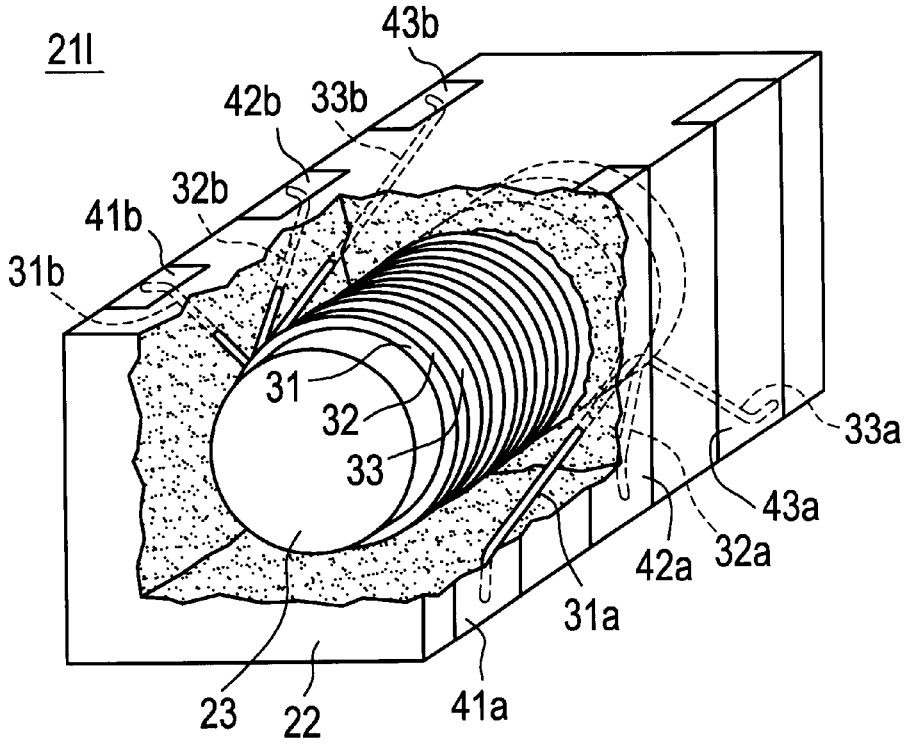
FIG. 20 is a partially broken perspective view schematically illustrating an inductor according to a twelfth preferred embodiment of the present invention.
Figure 21:
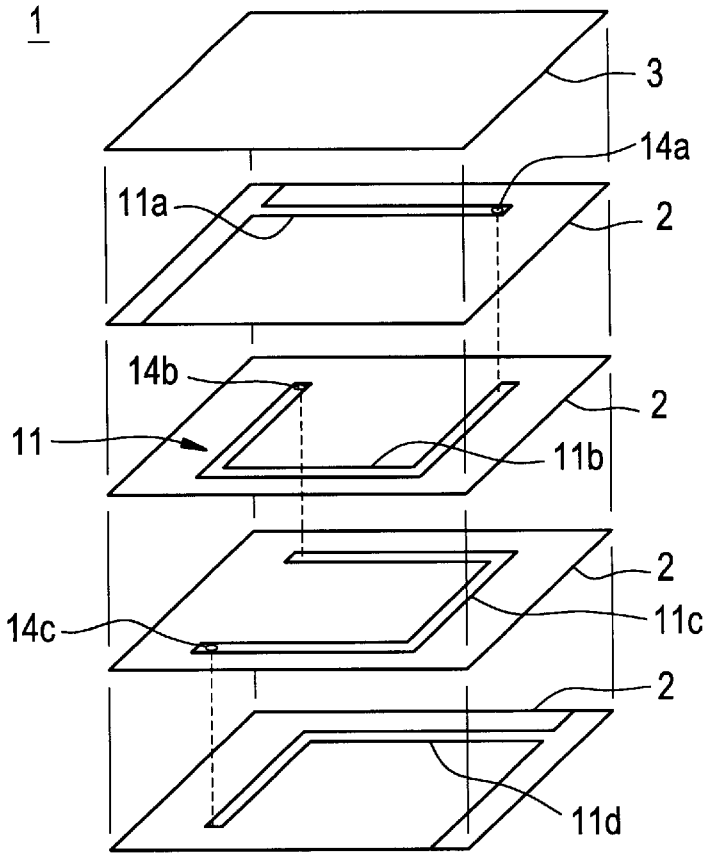
FIG. 21 is an exploded perspective view schematically illustrating an inductor of a laminated type made according to a prior art.
Figure 22:
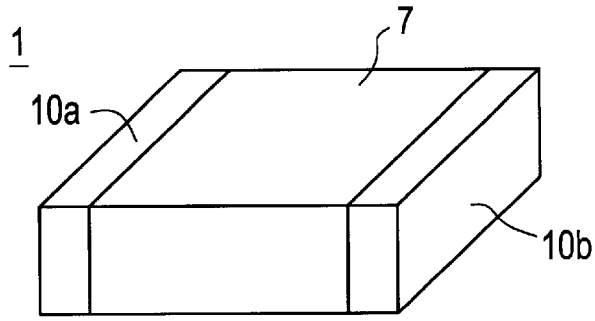
FIG. 22 is a perspective view schematically indicating an outside appearance of the inductor shown in FIG. 21.

FIG. 20 is a partially broken perspective view schematically illustrating an inductor 21*l* according to a twelfth preferred embodiment of the present invention. As shown in FIG. 20, the inductor 21*l* is constituted on the basis of the inductor 21*c* shown in FIG. 10, including a substantially rectangular parallelepiped magnetic sintered body 22 made of a ferrite material, and three coils 31–33 wound around one magnetic core member 23, all contained within the magnetic sintered body 22, thereby forming a trifilar winding. As a result, the inductor 21*l* can provide the same effect as can be provided by the inductor 21*c* shown in FIG. 10.

The present invention should not be limited to the above-described preferred embodiments. In fact, there are many possible modifications falling within the scope of the present invention. For example, a magnetic core member is not necessarily required to have a substantially circular cross section, and instead may have a magnetic core member having a substantially rectangular cross section. Further, although it has been described in the above preferred embodiments that a wet pressing treatment may be used for treating the slurry, it is also possible to use a resin hardening method, a mold casting method, or a gel casting method or other suitable method. In addition, although it has been described in the above preferred embodiments that the electrically conductive wires are wound in a spiral manner, it is also possible that such electrically conductive wires may be arranged in a linear manner.

As may be understood from the above description, according to various preferred embodiments of the present invention, there is provided an improved inductor which is characterized in that a coil assembly having an electrically conductive wire or having a magnetic core member and an electrically conductive wire wound around the magnetic core member, is contained within a magnetic sintered body which has been formed by molding a ceramic slurry into a predetermined shape and sintering to produce a magnetic sintered body, wherein end portions of the electrically conductive wire are electrically connected to external electrodes provided on outer surfaces of the magnetic sintered body. Therefore, in using the above inductor having the above-described structure, a magnetic sintered body which has been formed by molding a ceramic slurry into a predetermined shape and sintered, defines a magnetic path of a magnetic flux generated by the electrically conductive wire. Further, since the electrically conductive wire has a relatively large cross section which is much larger than that of a conductor pattern of a conventional laminated type inductor, the electrically conductive wire has a greatly reduced direct current resistance, thereby significantly increasing the current capacity for the inductor.

Further, according to various preferred embodiments of the present invention, there is provided another inductor in which a plurality of coil assemblies each having a magnetic core member and an electrically conductive wire wound around the magnetic core member, with the plurality of coil assemblies being electrically independent from one another, are contained within a magnetic sintered body which has been formed by molding a ceramic slurry into a predetermined shape and sintered, thereby forming an array type inductor having a greatly increased current capacity. Moreover, since either a plurality of non-magnetic members or a plurality of internal spaces are provided between the plurality of coil assemblies in the magnetic sintered body, formation of a magnetic circuit between two adjacent coil assemblies is effectively prevented by either the non-magnetic members or the internal spaces. In this way, a magnetic flux generated by one coil assembly will not form an interconnection with another magnetic flux generated by an adjacent coil assembly. Also, leakage of a signal or a noise between adjacent coil assemblies is prevented. In addition, since there is only a small mutual electromagnetic coupling between each pair of adjacent coil assemblies, a distance between each pair of adjacent coil assemblies can be much smaller than that of a conventional inductor, thereby permitting the formation of an inductor which has a significantly reduced size.

Moreover, according to the present invention, there is provided a further inductor in which at least a pair of mutually electrically connected coil assembles each having a magnetic core member and an electrically conductive wire wound around the magnetic core member, are contained within a magnetic sintered body which has been formed by molding a ceramic slurry into a predetermined shape and sintered. Therefore, a method of making an inductor produces an inductor having a greatly increased current capacity and such that the inductor can be used as a transformer or a common mode choke coil.

Further, since the non-magnetic member(s) or the internal space(s) are provided between the at least one pair of coil assemblies, a part of the magnetic sintered body between the at least one pair of coil assemblies, will have a higher magnetic resistance. As a result, a large part of a magnetic flux generated by one coil assembly will form an interconnection with a magnetic flux generated by the other coil assembly. Consequently, an inductor having a very strong electromagnetic coupling and a large coupling coefficient between every two adjacent coil assemblies is provided.

Moreover, since the inductors may be manufactured using a wet pressing treatment, the production of the inductors is extremely simple and has a very low cost. Also, it is not necessary to use a complex process which involves printing conductor patterns and laminating a plurality of magnetic sheets. Thus, the methods of various preferred embodiments of the present invention enable very low cost, mass-production of inductors having excellent characteristics. Moreover, since the slurry is sufficiently pressed during the wet pressing treatment, a water component contained in the slurry is sufficiently removed therefrom, thereby effectively preventing formation of air bubbles within the slurry and thus ensuring a good quality for the molded product. In addition, since each electrically conductive wire is wound around a magnetic core member, deformation of the electrically conductive wire is reliably prevented.

Further, in the method of various preferred embodiments of the present invention for manufacturing an inductor, after the slurry is poured into a mold to perform the wet pressing treatment to produce a magnetic molded plate, a plurality of coil assemblies are fixed on the magnetic molded plate, and such magnetic molded plate is placed into a mold for forming a magnetic molded body. Therefore, it is not necessary to directly place the plurality of coil assemblies into the mold, thereby ensuring an improved productivity for manufacturing the inductor.

While the invention has been particularly shown and described with reference to preferred embodiments thereof, it will be understood by those skilled in the art that the forgoing and other changes in form and details may be made therein without departing from the spirit of the invention.

What is claimed is:

1. A method of manufacturing an inductor, the method comprising the steps of:

preparing a slurry containing a magnetic ceramic material;

introducing the slurry into a mold in which an electrically conductive wire has been placed;

conducting wet pressing treatment of the slurry in the mold to obtain a magnetic molded body containing the electrically conductive wire;

sintering the magnetic molded body containing the electrically conductive wire, so as to form a magnetic sintered body; and forming, on outer surfaces of the magnetic sintered body, external electrodes electrically connected to end portions of the electrically conductive wire.

2. The method according to claim 1, wherein the slurry includes a raw material powder, water, a dispersing agent, a defoaming agent and a binding agent.

3. The method according to claim 1, wherein the magnetic sintered body is formed and arranged so as to function as a magnetic path allowing the passing of a magnetic flux generated by the electrically conductive wire.

4. The method according to claim 1, wherein during the wet pressing treatment step, the slurry is pressed and a water component of the slurry escapes so as to form the magnetic molded body and so as to prevent formation of air bubbles in the slurry.

5. The method according to claim 1, wherein the magnetic sintered body has a shape that is substantially rectangular parallelepiped.

6. A method of manufacturing an inductor, the method comprising the steps of:

preparing a slurry containing a magnetic ceramic material;

forming a coil assembly having a magnetic core member and an electrically conductive wire wound around the magnetic core member;

placing the coil assembly into a mold;

introducing the slurry into the mold in which the coil assembly has been placed;

performing wet pressing treatment of the slurry in the mold to obtain a magnetic molded body containing the coil assembly;

sintering the magnetic molded body containing the coil assembly, so as to form a magnetic sintered body; and forming, on outer surfaces of the magnetic sintered body containing the coil assembly, external electrodes electrically connected to end portions of the electrically conductive wire.

7. The method according to claim 6, wherein the slurry includes a raw material powder, water, a dispersing agent, a defoaming agent and a binding agent.

8. The method according to claim 6, further comprising the steps of placing a plurality of the coil assemblies into the mold, placing the plurality of coil assemblies into the mold, introducing the slurry into the mold in which the plurality of coil assemblies have been placed, performing wet pressing treatment of the slurry in the mold to obtain a magnetic molded body containing the plurality of coil assemblies and sintering the magnetic molded body containing the plurality of coil assemblies, so as to form a magnetic sintered body.

9. The method according to claim 8, further comprising the step of providing non-magnetic plates between each of the plurality of coil assemblies.

10. The method according to claim 8, further comprising the step of providing spaces between each of the plurality of coil assemblies.

11. A method of manufacturing an inductor, the method comprising the steps of:

preparing a slurry containing a magnetic ceramic material;

introducing the slurry into a mold;

performing wet pressing treatment of the slurry in the mold to produce a magnetic molded plate;

forming at least one coil assembly having a magnetic core member and an electrically conductive wire wound around the magnetic core member;

fixing the at least one coil assembly on the magnetic molded plate;

putting the magnetic molded plate and the at least one coil assembly fixed thereto into a mold;

introducing the slurry into the mold in which the magnetic molded plate and the at least one coil assembly has been placed;

performing wet pressing treatment of the slurry in the mold with the magnetic molded plate and the at least one coil assembly so as to obtain a magnetic molded body containing the at least one coil assembly;

sintering the magnetic molded body containing the at least one coil assembly to form a magnetic sintered body; and forming, on outer surfaces of the magnetic sintered body containing the at least one coil assembly, external electrodes electrically connected to end portions of the electrically conductive wire of the at least one coil assembly.

12. The method according to claim 11, wherein the slurry includes a raw material powder, water, a dispersing agent, a defoaming agent and a binding agent.

13. The method according to claim 11, further comprising the steps of fixing a plurality of the coil assemblies onto the magnetic molded plate, placing the magnetic molded plate and plurality of coil assemblies mounted thereon into the mold, introducing the slurry into the mold in which the magnetic molded plate and the plurality of coil assemblies have been placed, performing wet pressing treatment of the slurry in the mold to obtain a magnetic molded body containing the magnetic molded plate and the plurality of coil assemblies and sintering the magnetic molded body containing the plurality of coil assemblies, so as to form a magnetic sintered body.

14. The method according to claim 13, further comprising the step of providing non-magnetic plates between each of the plurality of coil assemblies.

15. The method according to claim 13, further comprising the step of providing spaces between each of the plurality of coil assemblies.

16. A method of manufacturing an inductor, the method comprising the steps of:

preparing a slurry containing a magnetic ceramic material;

introducing the slurry into a mold;

performing wet pressing treatment of the slurry in the mold to produce a magnetic molded plate;

fixing on the magnetic molded plate at least one coil assembly having an electrically conductive wound wire;

placing the magnetic molded plate and the at least one coil assembly fixed thereto into a mold;

introducing the slurry into the mold in which the magnetic molded plate and the at least one coil assembly has been placed;

performing wet pressing treatment of the slurry, the magnetic molded plate and the at least one coil assembly so as to obtain a magnetic molded body containing the at least one coil assembly;

sintering the magnetic molded body containing the at least one coil assembly to form a magnetic sintered body; and forming, on outer surfaces of the magnetic sintered body containing the at least one coil assembly, external electrodes electrically connected to end portions of the electrically conductive wire of the at least one coil assembly.

17. The method according to claim 16, wherein the slurry includes a raw material powder, water, a dispersing agent, a defoaming agent and a binding agent.

18. The method according to claim 16, further comprising the steps of fixing a plurality of the coil assemblies onto the magnetic molded plate, placing the magnetic molded plate and plurality of coil assemblies mounted thereon into the mold, introducing the slurry into the mold in which the magnetic molded plate and the plurality of coil assemblies have been placed, performing wet pressing treatment of the slurry in the mold to obtain a magnetic molded body containing the magnetic molded plate and the plurality of coil assemblies and sintering the magnetic molded body containing the plurality of coil assemblies, so as to form a magnetic sintered body.

19. The method according to claim 18, further comprising the step of providing non-magnetic plates between each of the plurality of coil assemblies.

20. The method according to claim 18, further comprising the step of providing spaces between each of the plurality of coil assemblies.

* * * * *